US011685022B2

(12) United States Patent
Poillot

(10) Patent No.: US 11,685,022 B2
(45) Date of Patent: Jun. 27, 2023

(54) ERGONOMIC PLIER

(71) Applicant: Stanley Black & Decker MEA FZE, Dubai (AE)

(72) Inventor: Anthony Poillot, Besancon (FR)

(73) Assignee: Stanley Black & Decker MEA FZE, Dubai (AE)

( * ) Notice: Subject to any disclaimer, the term of this patent is extended or adjusted under 35 U.S.C. 154(b) by 363 days.

(21) Appl. No.: 17/127,183

(22) Filed: Dec. 18, 2020

(65) Prior Publication Data

US 2021/0187702 A1 Jun. 24, 2021

(30) Foreign Application Priority Data

Dec. 19, 2019 (EP) ..... 19218319

(51) Int. Cl.

*B25B 7/12* (2006.01)
*B25B 7/02* (2006.01)
*B26B 13/04* (2006.01)

(52) U.S. Cl.

CPC ..... *B25B 7/126* (2013.01); *B25B 7/02* (2013.01); *B26B 13/04* (2013.01)

(58) Field of Classification Search

CPC .. B25B 7/126; B25B 7/02; B25B 7/04; B25B 7/06; B25B 7/08; B25B 7/10; B25B 7/18; B26B 13/04; B26B 15/00; B26B 17/02; B26B 17/00; B26B 13/26; A01G 3/02; A01G 3/025; A01G 3/0255; A01G 3/04

See application file for complete search history.

(56) References Cited

U.S. PATENT DOCUMENTS 3,372,479 A * 3/1968 Fischer ..... B26B 17/02 81/301
3,786,550 A * 1/1974 Jones ..... B25B 31/005 29/243.519
3,998,032 A * 12/1976 Koebbeman ..... B67B 3/14 53/352
4,646,740 A * 3/1987 Peters ..... A61B 17/128 606/143
4,987,722 A * 1/1991 Koebbeman ..... B67B 3/02 29/243.517
5,511,297 A 4/1996 Cross
5,575,805 A 11/1996 Li
11,406,060 B1 * 8/2022 Daugherty ..... B25J 11/0055

(Continued)

FOREIGN PATENT DOCUMENTS

CN 205414557 * 3/2016
GB 666917 A 2/1952

OTHER PUBLICATIONS

Extended European Search Report for EP Application No. 19218319.2 dated Jun. 20, 2019, 5 pages.

*Primary Examiner* — Evan H MacFarlane
*Assistant Examiner* — Fernando A Ayala
(74) *Attorney, Agent, or Firm* — Caeden Drayton

(57) ABSTRACT

The present invention relates to an ergonomic plier tool. More specifically, the invention relates to a piston actuated ergonomic plier tool having a 360-degree rotative and exchangeable head. The tool includes a body, lever, head cylinder, piston and jaw assembly. The disclosed tool allows an operator to work in tight spaces with her hand in one plane, while cutting/manipulating an object in an infinite number of planes different from that of her hand.

9 Claims, 7 Drawing Sheets

(56) References Cited

U.S. PATENT DOCUMENTS

| | | | | |
|---|---|---|---|---|
| 2009/0173133 | A1* | 7/2009 | Batten | B25B 27/146<br>72/409.16 |
| 2015/0080876 | A1* | 3/2015 | Worrell | A61B 18/1445<br>606/34 |
| 2016/0363510 | A1* | 12/2016 | Kanack | B25B 27/10 |

* cited by examiner

ERGONOMIC PLIER

RELATED APPLICATIONS

This patent application claims priority to EP19218319.2, filed Dec. 19, 2019, which is hereby incorporated by reference in its entirety.

FIELD OF THE INVENTION

The present invention relates to an ergonomic plier tool. More specifically, the invention relates to a piston actuated ergonomic plier tool having a rotative and exchangeable head.

BACKGROUND OF THE INVENTION

The general concept of a pliers or cutting snips is well known. These handheld tools are used to manipulate or cut various objects. Typically, these tools include first and second arms that are rotatably held together at a fulcrum. At one end, these arms include opposing working portions and handles portions at the ends distal thereto. In operation, a user moves the handles ends close to one another, which, in turn closes the working portions so that an object can be manipulated or cut. Critically, these standard tools can only function in a single orientation or plane. In other words, as the handles are moved together through an imaginary X-Y plane, the working portions also operate through the same X-Y plane. This lack of versatility is a drawback.

Mechanics, electricians or even your average do-it-yourselfer, often need to use their tools in tight spaces. It is not uncommon for these tight spaces to only offer space for an operator's hand in the X-Y plane, but the object to be cut/manipulated is in the X-Z plane. In this situation, standard pliers/snips would not be effective. It would be advantageous to have a tool that would allow an operator's hand to function in one plane while the working end of the tool operators in a second different plane. In addition to the foregoing, it would also be advantageous to have a tool that has replaceable heads such that it could operate as either pliers or snips. The present invention overcomes one or more of the foregoing shortcomings.

SUMMARY OF THE INVENTION

According to an aspect of the invention, a tool having a body defining a cavity and including a handle portion. The tool also includes a lever hingedly fixed to the body. The lever includes both a piston engaging portion and a trigger portion. The piston engaging portion of the lever is disposed within the cavity of the body. The lever is also movable between a first position and a second position. In the first position, the trigger portion is distal from the handle portion and the piston engaging portion is proximal thereto. In the second position, the trigger portion is proximal to the handle portion and the piston engaging portion is distal thereto. The tool also includes a head cylinder that is at least partially disposed within the cavity. The head cylinder has a body engaging portion and a jaw receiving portion. The body engaging portion (26) further defines a piston cavity that opens into the jaw receiving portion. The tool also includes a piston disposed within the piston cavity. The piston includes a lever engaging portion and a jaw engaging portion. The piston is movable between a retracted position and an advanced position. In the retracted position, the piston does not extend into the jaw receiving portion. In the advanced position, the piston extends into the jaw receiving portion. The tool also includes a jaw assembly disposed in the jaw receiving portion. The jaw assembly includes a first jaw and second jaw that are rotatably coupled to one another at a fulcrum. Each of the first and second jaws include a working portion and a piston engaging portion. The jaw assembly is movable between an open position and a closed position. In the open position, the respective working portions are spaced apart from one another and the piston engaging portions are adjacent one another. In the closed position, the respective working portions are adjacent one another and the piston engaging portions are spaced apart. The tool is characterized in that the head cylinder is freely rotatable within the cavity. The tool is further characterized in that in that the piston engaging portion of the lever is in communication with the lever engaging portion of the piston, and the jaw engaging portion of the piston is in communication with the piston engaging portions of the jaws, such that when the lever is moved from its first position to it second position, the piston is moved from its retracted position to its advanced position, and the jaw assembly is moved from its open position to its closed position.

These and other objects, features, and characteristics of the present invention, as well as the methods of operation and functions of the related elements of structure and the combination of parts and economies of manufacture, will become more apparent upon consideration of the following description and the appended claims with reference to the accompanying drawings, all of which form a part of this specification, wherein like reference numerals designate corresponding parts in the various figures. In one embodiment of the invention, the structural components illustrated herein are drawn to scale. It is to be expressly understood, however, that the drawings are for the purpose of illustration and description only and are not intended as a definition of the limits of the invention. In addition, it should be appreciated that structural features shown or described in any one embodiment herein can be used in other embodiments as well. As used in the specification and in the claims, the singular form of "a", "an", and "the" include plural referents unless the context clearly dictates otherwise.

BRIEF DESCRIPTION OF THE DRAWINGS

Features of the tool in accordance with one or more embodiments are shown in the drawings, in which like reference numerals designate like elements. The drawings form part of this original disclosure in which.

DETAILED DESCRIPTION OF THE ILLUSTRATED EMBODIMENT(S)

Figure 1:
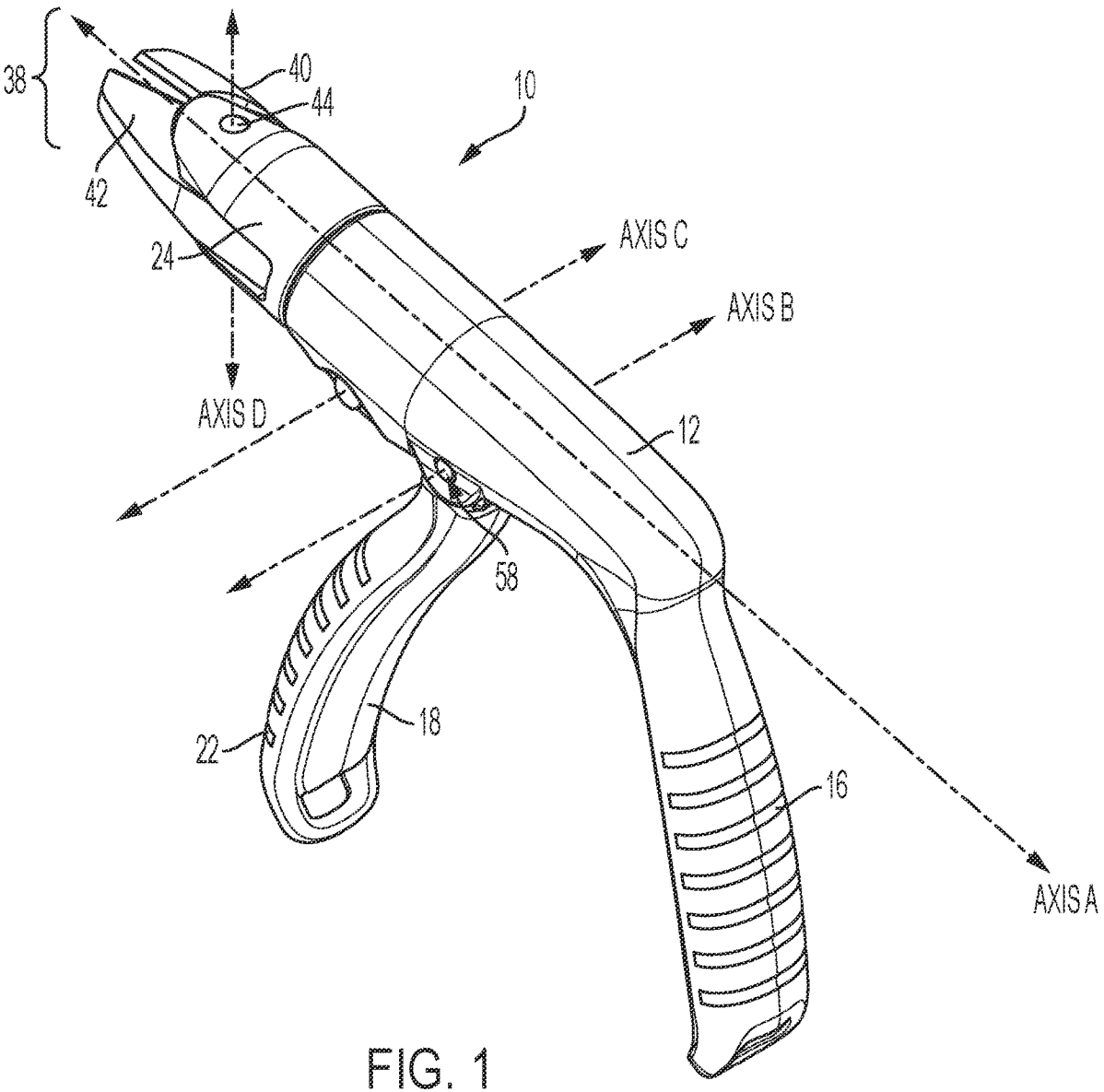
FIG. 1 illustrates a perspective view of the tool according the present disclosure.
Figure 2:
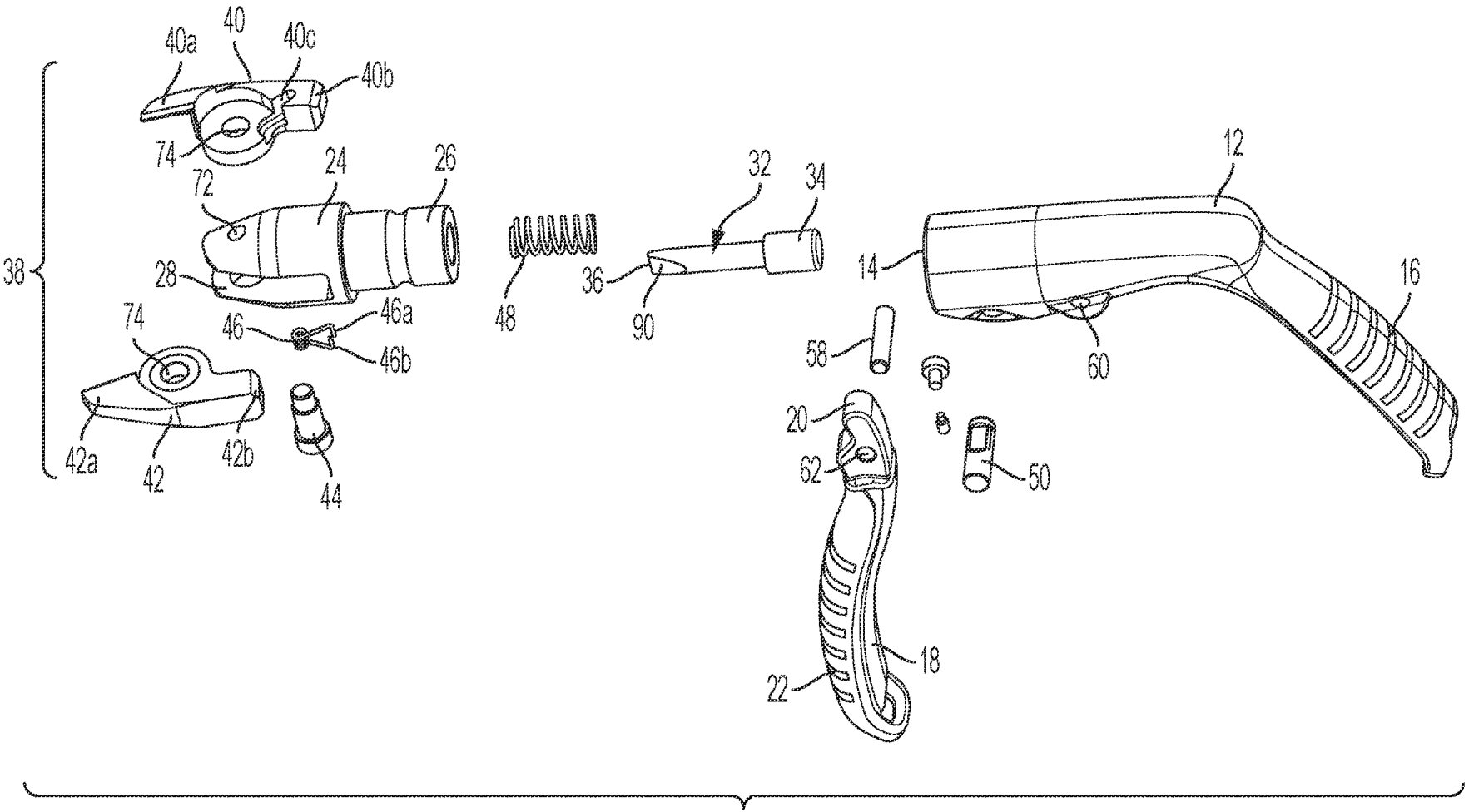
FIG. 2 illustrates an exploded view of the tool.
Figure 5:
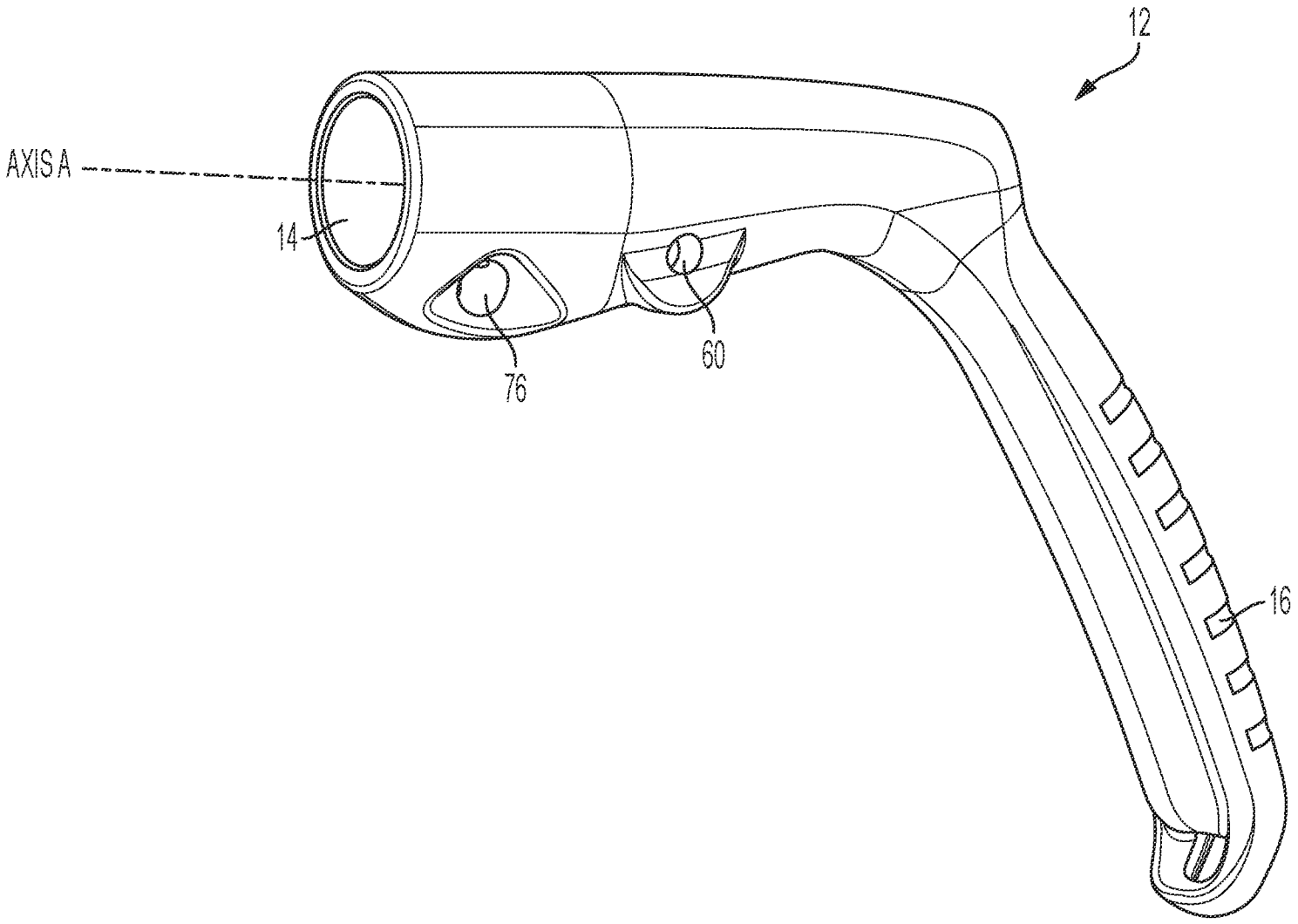
FIG. 5 illustrates a detailed perspective view of the body of the tool.

FIGS. 1 and 2 respectively illustrate perspective and exploded views of a tool 10 according to the present invention. The tool 10 includes a body 12, a lever 18, a head cylinder 24, a piston 32, and a jaw assembly 38, which includes first and second jaws 40, 42. Body 12 defines a cavity 14 and also includes a handle portion 16. Generally speaking, body 12 is L-shaped with the cavity 14 and the handle portion being spaced apart. As best seen in FIG. 5, the cavity 14 is positioned along Axis A.

Figure 3:
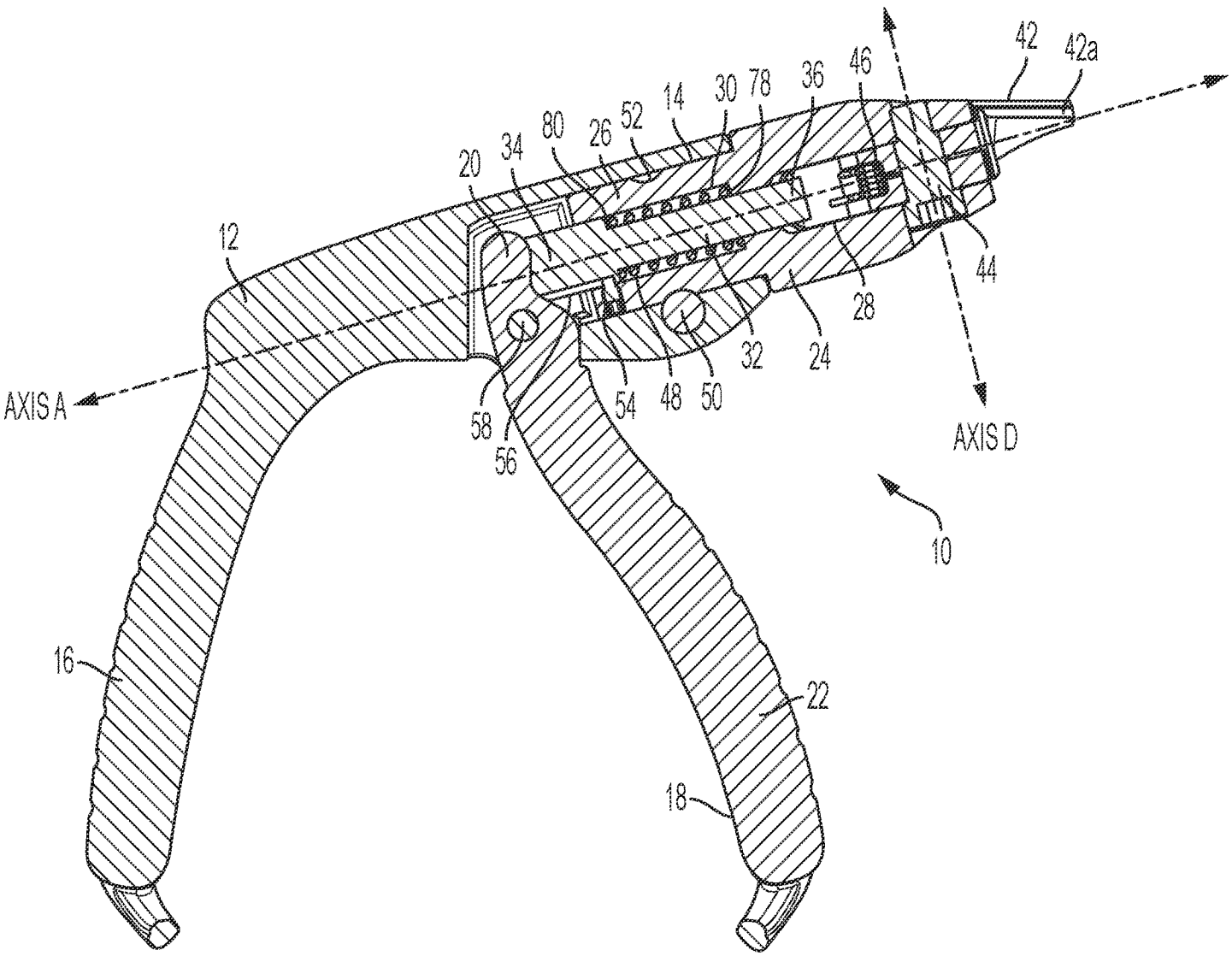
FIG. 3 illustrates a cross-sectional view of the tool.
Figure 4:
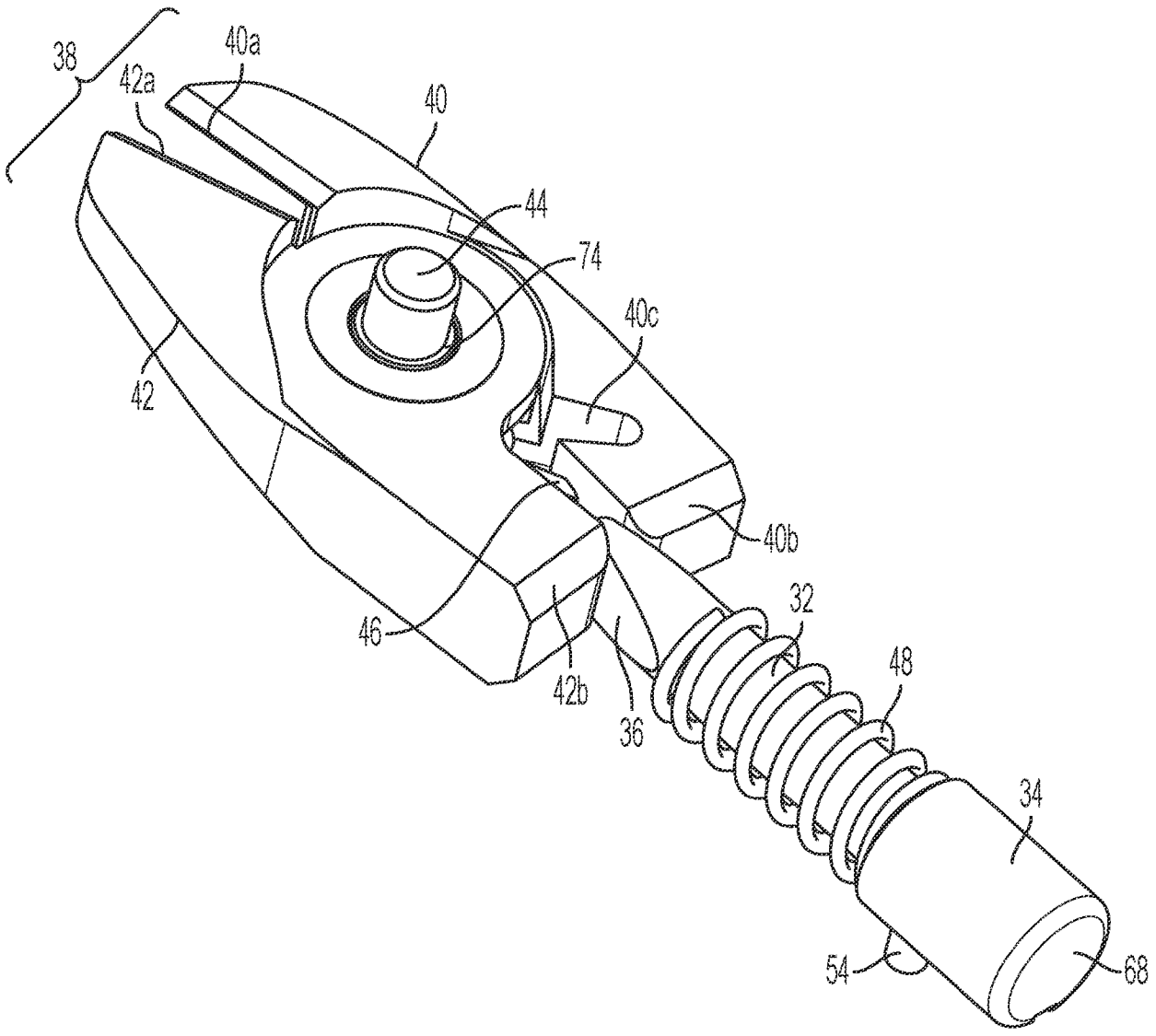
FIG. 4 illustrates a detailed perspective view of piston of the tool engaging the assembly.

As shown in FIG. 3, Lever 18 is hingedly fixed to the body 12. Lever 18 also includes a piston engaging portion 20 and a trigger portion 22. In a preferred embodiment, lever 18 is secured to the body by a pivot axis 58. Pivot axis 58 is oriented along Axis B, which is fixed in the same plane as Axis A but substantially perpendicular thereto. secures lever 18 to the body 12 by simultaneously being disposed through lever stirrups 60 and pivot cavity 62. In a preferred embodiment, lever stirrups 60 are defined by the body 12 and the pivot cavity 62 is defined by the lever. However, those skilled in the art will recognize that the hinged arrangement of securing the lever 18 to the body 12 can be accomplished in a variety of ways without departing from the scope of the invention.

Lever 18 is hingedly secured to the body 12 such that the piston engaging portion 20 is disposed within the cavity 14. Lever 18 is free to move about pivot axis 58 between a first and second position. In the first position the trigger portion 22 of the lever 18 is distal from the handle portion 16 of the body 12, and the piston engaging portion 20 of the lever 18 is proximal to the handle portion 16 of the body 12. In the second position, the trigger portion 22 of the lever 18 is proximal to the handle portion 16 of the body and the piston engaging portion 20 of the lever 18 is distal to the handle portion 16 of the body 12.

Figure 6:
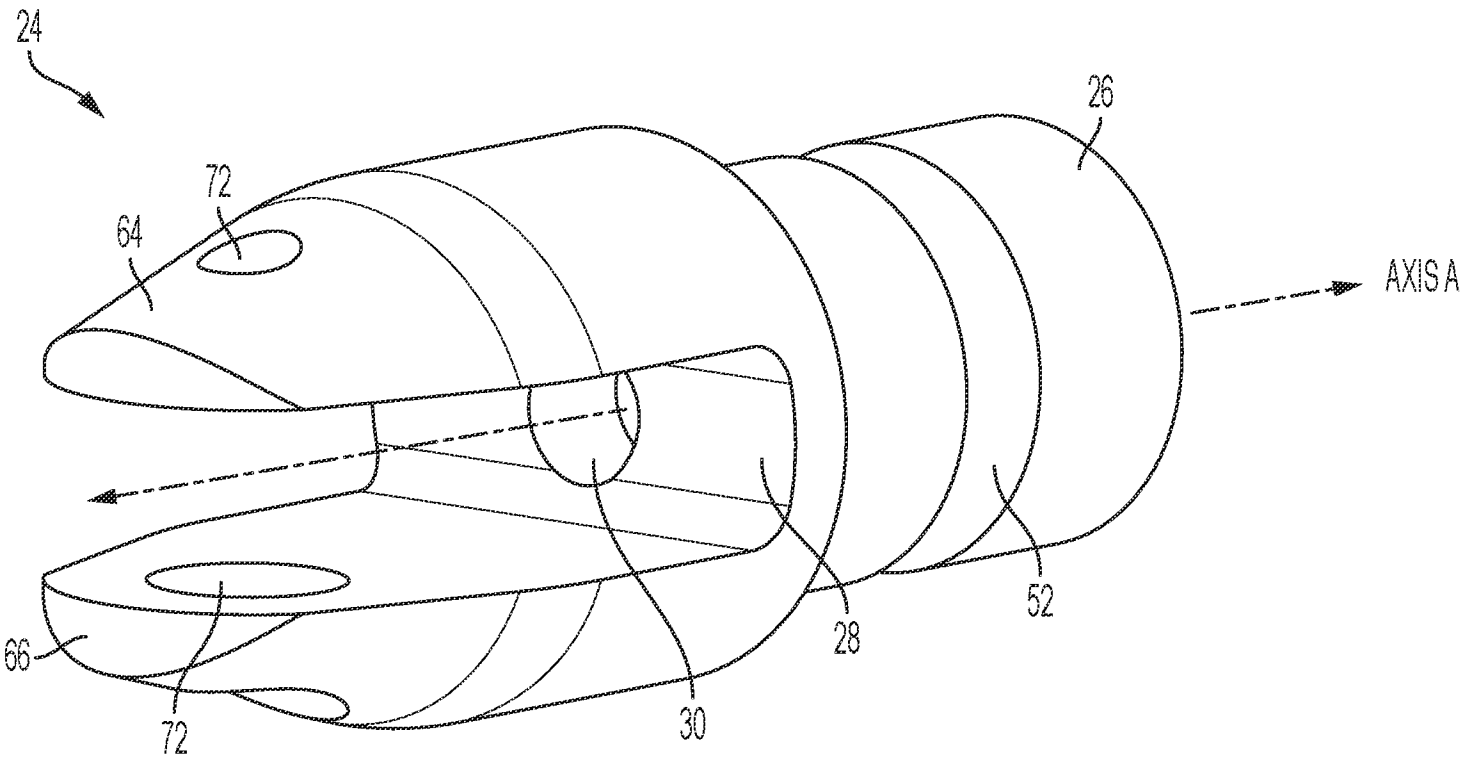
FIG. 6 illustrates a detailed perspective view of the head cylinder.

The head cylinder 24 of the tool 10 includes a body engaging portion 26 and a jaw receiving portion 28. As best seen in FIG. 6, the body engaging portion defines a piston cavity 30 that opens into the jaw receiving portion 28. In the preferred embodiment, piston cavity 30 is positioned along Axis A. The jaw receiving portion 38 preferably includes two opposing tines 64, 66, which extend away from the body receiving portion 26.

The body engaging portion 26 of the head cylinder 24 is also configured to be disposed within the cavity 14 of the body. An axle lock 50 may secure the body engaging portion within the cavity 14. In a preferred embodiment, axle lock 50 is disposed in an axle cavity 76 defined by the body 12. Axle cavity 76 is oriented along Axis C, which, similar to Axis B, is fixed in the same plane as Axis A but substantially perpendicular thereto. Additionally, axle cavity 76 is positioned such that when axle lock 50 is disposed therein, at least a portion of the axle lock 50 extends into the cavity 14. In operation, the axle lock 50 secures the head cylinder 24 to the body 12, by engaging an axle groove 52 in the body engaging portion 26 of the head cylinder 24. Preferably, the axle groove 52 is circumferential about the body engaging portion 26. The engagement of the axle lock 50 to the axle groove 52, secures the head cylinder 24 to the body 12 by limiting axial movement of the head cylinder along Axis A. At the same time, the engagement, between the axle lock 50 and the axle groove 52, permits the free rotation of the head cylinder 24 about Axis A.

Figure 7:
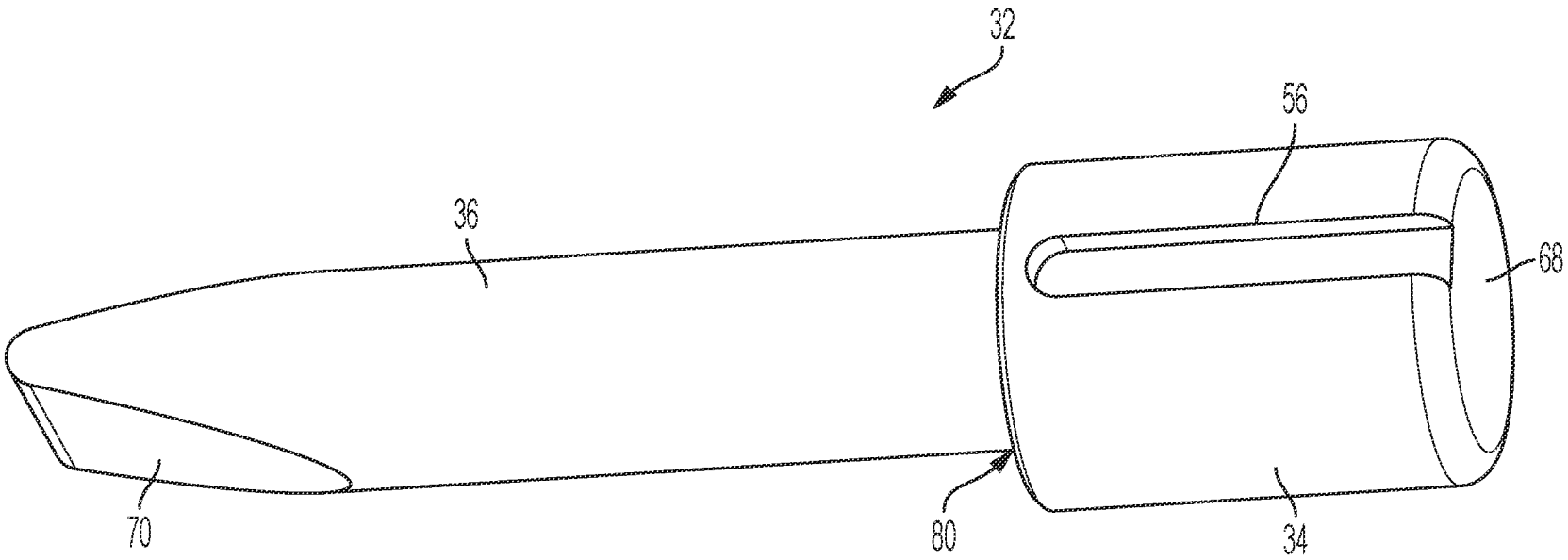
FIG. 7 illustrates a detailed perspective view of the piston.

FIG. 7 illustrates a perspective view of piston 32, which is substantially cylindrical and includes a lever engaging portion 34 and a jaw engaging portion 36. As expected, the lever engaging portion 34 includes a surface 68 that is intended to be engaged by the piston engaging portion 20 of the lever 18. In a preferred embodiment, the diameter of the lever engaging portion 34 is larger than that of the jaw engaging portion 36, which is sized to fit within the piston cavity 30. Also, preferably, the jaw engaging portion 36 may include one or more tapered surfaces 70. FIG. 7 shows tapered surface 70 as being two tapers about a rounded end. However, those skilled in the art will recognize that tapered surface 70 could also be a single conical taper that has a pointed end.

Piston 32 is also configured to move along Axis A between a retracted position and an advanced position. In the retracted position, piston 32 (and more specifically surface 70) does not extend into the jaw receiving portion 28 of the head cylinder 24. In the advanced position, piston 32 (and more specifically, surface 70) extends into the jaw receiving portion 28 of the head cylinder.

In a preferred embodiment, the tool may also include a piston spring 48 that is disposed about the jaw engaging portion 36 of the piston 32. As best seen in FIG. 3, the piston spring 48 is configured bias the piston 32 toward its retracted position by engaging an interior wall 78 of the piston cavity 30 and a spring surface 80 of the lever engaging portion 34 of the piston. Axial movement of the piston toward its retracted position may be limited by a grub screw 54 disposed within the cavity 14 and configured to engage a piston groove 56. As best shown in FIG. 7, piston groove 56 is preferably formed in the lever engaging portion 34 of piston 32.

Tool 10 also includes a jaw assembly 38 disposed in the jaw receiving portion 28 of the head cylinder 24. The jaw assembly 38 preferably includes a first jaw 40 and a second jaw 42 coupled together at a fulcrum 44. Each of the first and second jaws include a working portion 40*a*, 42*a* and a piston engaging portion 40*b*, 42*b*. Jaws 40, 42, which may be mirror images of one another, are configured to operate by rotating around the fulcrum 44. In operation, fulcrum 44 may be a jaw pivot axle which not only facilitates the rotational movement of the jaws, it also secures the jaws to the head cylinder 24.

In a preferred embodiment, each of the tines 64, 66 of the head cylinder 24 define jaw stirrups 72. Similarly, each of the jaws 40, 42 also define a jaw cavity 74. The jaws are secured within the head cylinder 24 by disposing the fulcrum (or jaw axle pivot) 44 through both the jaw stirrups 72 and the jaw cavities 74.

The jaws 40, 42 of the jaw assembly 38 are configured to rotate about the fulcrum 44, such that the opposing working portions 40*a*, 42*a* come together as the jaw engaging portions 40*b*, 42*b* are moved away from one another. This is considered to be the closed position of the jaw assembly. Conversely, the jaw assembly is in the open position when the working portions 40*a*, 42*a* are spaced apart and the jaw engaging portions 40*b*, 42*b* are adjacent one another.

The jaw assembly 38 may further include a jaw spring 46 that is configured to bias the jaw assembly in its open position. In a preferable embodiment, the jaw spring 46 may be a circular spring having first and second tines 46*a*, 46*b*. These tines 46*a*, 46*b* are configured to be disposed in spring grooves 40*c*, 42*c* of jaws 40, 42. Spring grooves 40*c*, 42*c* are positioned such that when tines 46*a*, 46*b* are in position, the piston engaging portions 40*b*, 42*b* of jaws 40, 42 are biased together, which in turn biases the working portions 40*a*, 40*b* away from each other. As explained above, this is defined as the open position of the jaw assembly.

The functionality of the tool will now be discussed. The piston engaging portion 20 of the lever 18 is in communication with the lever engaging portion 34 of the piston 32 such that when the lever 18 is moved from its first position to its second position, the piston 32 moves from its retracted position to its advanced position. The jaw engaging portion 36 of the piston 32 is in selective communication with the piston engaging portions 40*b*, 42*b* of the jaws 40, 42. When the piston 32 is in its retracted position, the jaw engaging portion 36 and the piston engaging portions 40*b*, 42*b* are not in communication and the jaw assembly 38 is in the its open position. Conversely, when the piston 32 is in its advanced position, the jaw engaging portion 36 is in communication with the jaw engaging portions 40*b*, 42*b* and the jaw assembly 38 is moved to its closed position.

INDUSTRIAL APPLICABILITY

The tool of the present disclosure provides the advantage of providing a user the comfort of a trigger type activation, and the versatility of being able to work in tight spaces through an infinite number of planes. In operation, the handle portion of the body is configured to rest comfortably in the palm of the hand. The trigger portion of the lever is configured to be engaged by the tips of one or more fingers. Thus, by using a natural squeezing or "gun-like" trigger action, a user can selectively operate the tool as needed. Ergonomically, this action is more comfortable for a user.

In addition to the ergonomic comfort, the present tool also has the advantage of being able to operate in tight spaces through an infinite number for planes. This is achieved through the free rotation of the head cylinder 24. It is not uncommon for a user to need to cut or manipulate an object that is in a plane different from that of the hand. If this is the case, the user can simply rotate the head cylinder 24 (and jaw assembly 38) to the desired plane while keeping the hand in its original plane. A simple squeeze of the trigger action lever will allow the user to cut or manipulate the object in this different plane as desired.

The presently disclosed tool is also versatile in its applicability. Although the figures depict a tool with jaw working portions 40*a*, 42*a* as being cutting edges for snips, the working portions could also be opposing tines of pliers, forceps, needle nose, scissors or any other tool that operates with a first arm and second arm coupled together at a fixed fulcrum.

Although aspects of the invention have been described in detail for the purpose of illustration based on what is currently considered to be the most practical and preferred embodiments, it is to be understood that such detail is solely for that purpose and that the invention is not limited to the disclosed embodiments, but, on the contrary, is intended to cover modifications and equivalent arrangements that are within the spirit and scope of the appended claims. For example, it is to be understood that the present invention contemplates that, to the extent possible, one or more features of any embodiment can be combined with one or more features of any other embodiment.

What is claimed is:

1. A tool, comprising: a body defining a cavity and including a handle portion; a lever hingedly fixed to the body and including a piston engaging portion and a trigger portion, wherein the piston engaging portion is disposed within the cavity, and wherein the lever is movable between a first position wherein the trigger portion is distal from the handle portion and the piston engaging portion is proximal to the handle portion, and a second position wherein the trigger portion is proximal to the handle portion and the piston engaging portion is distal to the handle portion; a head cylinder at least partially disposed within the cavity having a body engaging portion and a jaw receiving portion, wherein the body engaging portion further defines a piston cavity that opens into the jaw receiving portion; a piston disposed within the piston cavity and including a lever engaging portion and a jaw engaging portion, and wherein said piston is movable between a retracted position, wherein the piston does not extend into the jaw receiving portion, and an advanced position, wherein the piston extends into the jaw receiving portion; a jaw assembly disposed in the jaw receiving portion and comprising a first jaw and second jaw rotatable coupled to one another at a fulcrum, and wherein each of the first and second jaws include a working portion and a piston engaging portion, and wherein the jaw assembly is movable between an open position, wherein the respective working portions are spaced apart from one another and the piston engaging portions are adjacent one another, and a closed position, wherein the respective working portions are adjacent one another and the piston engaging portions are spaced apart; and characterised in that the head cylinder is freely rotatable within the cavity and further characterised in that the piston engaging portion of the lever is in communication with the lever engaging portion of the piston, and the jaw engaging portion of the piston is in communication with the piston engaging portions of the jaws, such that when the lever is moved from the lever's first position to the lever's second position, the piston is moved from the piston's retracted position to the piston's advanced position, and the jaw assembly is moved from the jaw assembly's open position to the law assembly's closed position.

2. The lever is moved from its first position distal from the hand port.

3. The tool according to claim 1, wherein the jaw assembly further includes a jaw spring configured to bias the jaw assembly toward the jaw's open position.

4. A tool according to claim 3, further comprising a grub screw configured to limit the axial movement of the piston toward its first position by engaging both the body and a piston groove in the lever engaging portion of the piston.

5. The tool of claim 1, wherein the head cylinder and jaw assembly are configured to be removable and replaceable.

6. A tool according to claim 4, further comprising a locking axle configured to secure the head cylinder to the body by engaging both the body and an axle groove formed on the body engaging portion of the head cylinder.

7. The tool of claim 5, wherein the axle groove is circumferential about the body engaging portion of the head cylinder.

8. A tool according to claim 1, wherein the working portions are cutting edges.

9. A tool according to claim 1, wherein the working portions are pliers.

* * * * *